US012502049B2

(12) United States Patent
Everson et al.

(10) Patent No.: US 12,502,049 B2
(45) Date of Patent: Dec. 23, 2025

(54) VENTING SYSTEM MONITORING FOR A DISHWASHER APPLIANCE

(71) Applicant: Haier US Appliance Solutions, Inc., Wilmington, DE (US)

(72) Inventors: Thomas Everson, Louisville, KY (US); Leah McBride, Louisville, KY (US); Ricardo Alberto Aguiar, Jr., Clarksville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/486,351

(22) Filed: Oct. 13, 2023

(65) Prior Publication Data

US 2025/0120562 A1 Apr. 17, 2025

(51) Int. Cl.
*A47L 15/00* (2006.01)
*A47L 15/48* (2006.01)

(52) U.S. Cl.
CPC ..... *A47L 15/0049* (2013.01); *A47L 15/488* (2013.01); *A47L 2401/30* (2013.01); *A47L 2401/32* (2013.01)

(58) Field of Classification Search
CPC ..... A47L 15/0049; A47L 15/488; A47L 2401/30; A47L 2401/32
USPC ..... 134/56 D
See application file for complete search history.

(56) References Cited

U.S. PATENT DOCUMENTS

| | | | | |
|---|---|---|---|---|
| 8,346,508 | B2 | 1/2013 | Kim et al. | |
| 10,470,640 | B2 | 11/2019 | Ryu et al. | |
| 2008/0184518 | A1* | 8/2008 | Taylor | A47L 9/2894 901/1 |
| 2016/0227981 | A1 | 8/2016 | Francisco | |
| 2018/0000311 | A1* | 1/2018 | Ryu | A47L 15/22 |

FOREIGN PATENT DOCUMENTS

| | | | |
|---|---|---|---|
| CN | 111956152 | A | 11/2020 |
| CN | 116269114 | A | 6/2023 |
| DE | 10204455 | A1 | 8/2003 |
| KR | 20220146910 | A * | 11/2022 |

OTHER PUBLICATIONS

KR20220146910A—machine translation (Year: 2022).*

* cited by examiner

*Primary Examiner* — Tinsae B Ayalew
(74) *Attorney, Agent, or Firm* — Dority & Manning, P.A.

(57) ABSTRACT

A dishwasher appliance includes a door pivotally providing selective access to the wash chamber and a venting system comprising a first fan for urging chamber air from the wash chamber and a second fan for urging ambient air, wherein the chamber air and the ambient air mix to create a mixed flow of air that is discharged from the dishwasher appliance. A controller is configured to energize the first fan and the second fan, monitor a power draw by the first fan and the second fan, determine that the venting system has malfunctioned based at least in part on the power draw by the first fan and the second fan, and implement a responsive action in response to determining that the venting system has malfunctioned based at least in part on the power draw.

17 Claims, 9 Drawing Sheets

VENTING SYSTEM MONITORING FOR A DISHWASHER APPLIANCE

FIELD OF THE INVENTION

The present subject matter relates generally to dishwasher appliances, and more particularly, to systems and methods for monitoring a fan venting system of a dishwasher appliance.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Certain conventional dishwasher appliances include venting systems for discharging hot air from the wash chamber after a wash cycle in order to expedite the drying process. However, too much moisture in the dry venting system can cause a poorly coated fan to rust and breakdown over time. A fault in the venting system can result in poor dishwasher dry performance or result in the leaking of moisture out of the vent conduit and onto the customer's floor. The service technician and customer will both have to spend time trying to diagnose why their dishes are not drying properly or why their dishwasher is leaking onto their floor. In addition, an improperly installed door fan can also cause the dry venting system to fail altogether.

Accordingly, a dishwasher appliance with an improved dry venting system is desired. More specifically, a system and method for identifying operating issues related to the dry venting system would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, a dishwasher appliance defining a vertical direction, a lateral direction, and a transverse direction is provided. The dishwasher appliance includes a wash tub positioned within a cabinet and defining a wash chamber, a door pivotally mounted to the cabinet to provide selective access to the wash chamber, a venting system comprising an exhaust fan for urging chamber air from the wash chamber, and a controller in operative communication with the exhaust fan. The controller is configured to energize the exhaust fan, monitor a power draw by the exhaust fan, determine that the venting system has malfunctioned based at least in part on the power draw by the exhaust fan, and implement a responsive action in response to determining that the venting system has malfunctioned based at least in part on the power draw.

In another exemplary embodiment, a method of operating a dishwasher appliance is provided. The dishwasher appliance includes a door providing selective access to a wash chamber and a venting system comprising a first fan for urging chamber air from the wash chamber and a second fan for urging ambient air, wherein the chamber air and the ambient air mix to create a mixed flow of air that is discharged from the dishwasher appliance. The method includes energizing the first fan and the second fan, monitoring a power draw by the first fan and the second fan, determining that the venting system has malfunctioned based at least in part on the power draw by the first fan and the second fan, and implementing a responsive action in response to determining that the venting system has malfunctioned based at least in part on the power draw.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
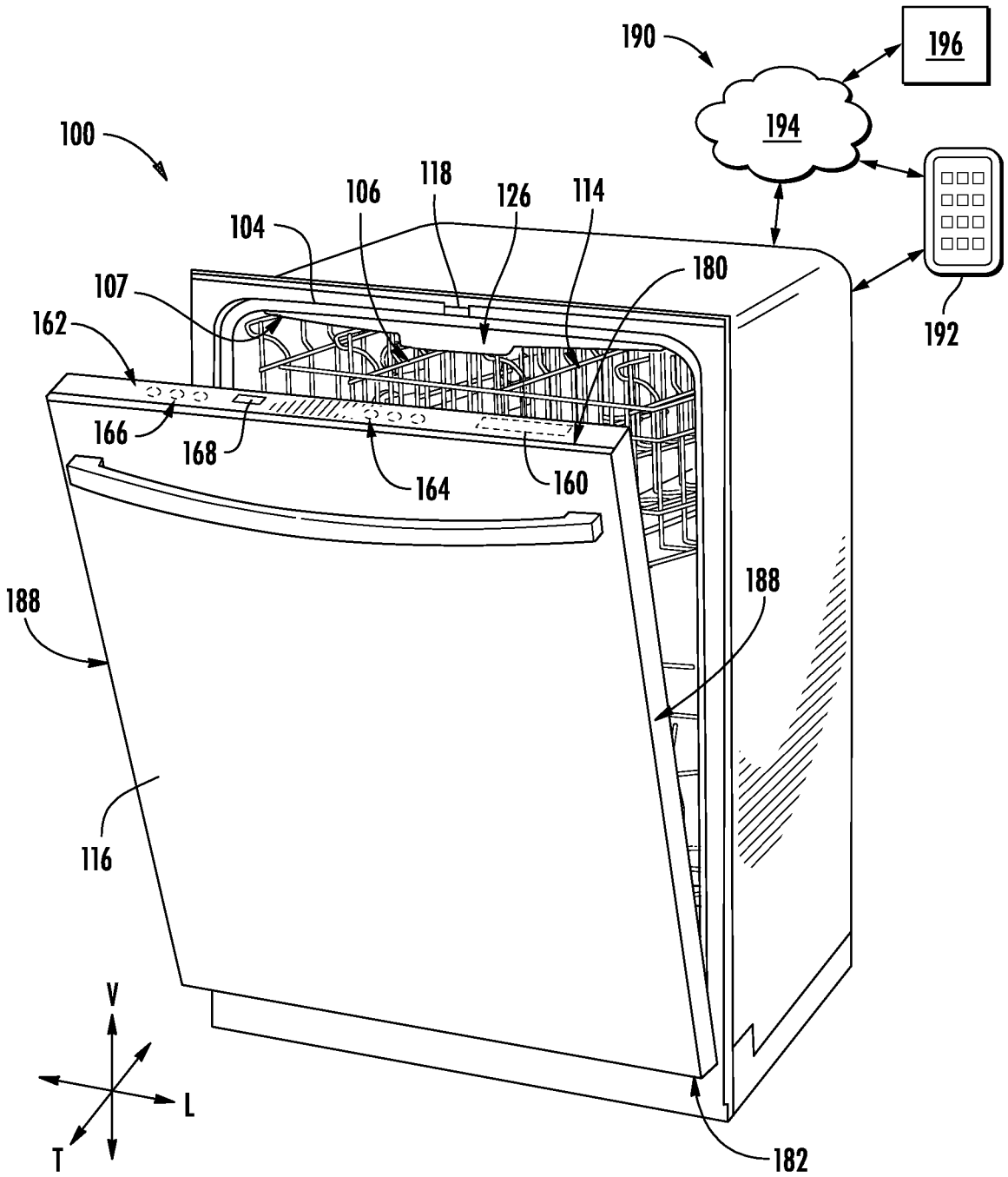
FIG. 1 provides a perspective view of a dishwasher appliance, including a dishwasher door according to an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
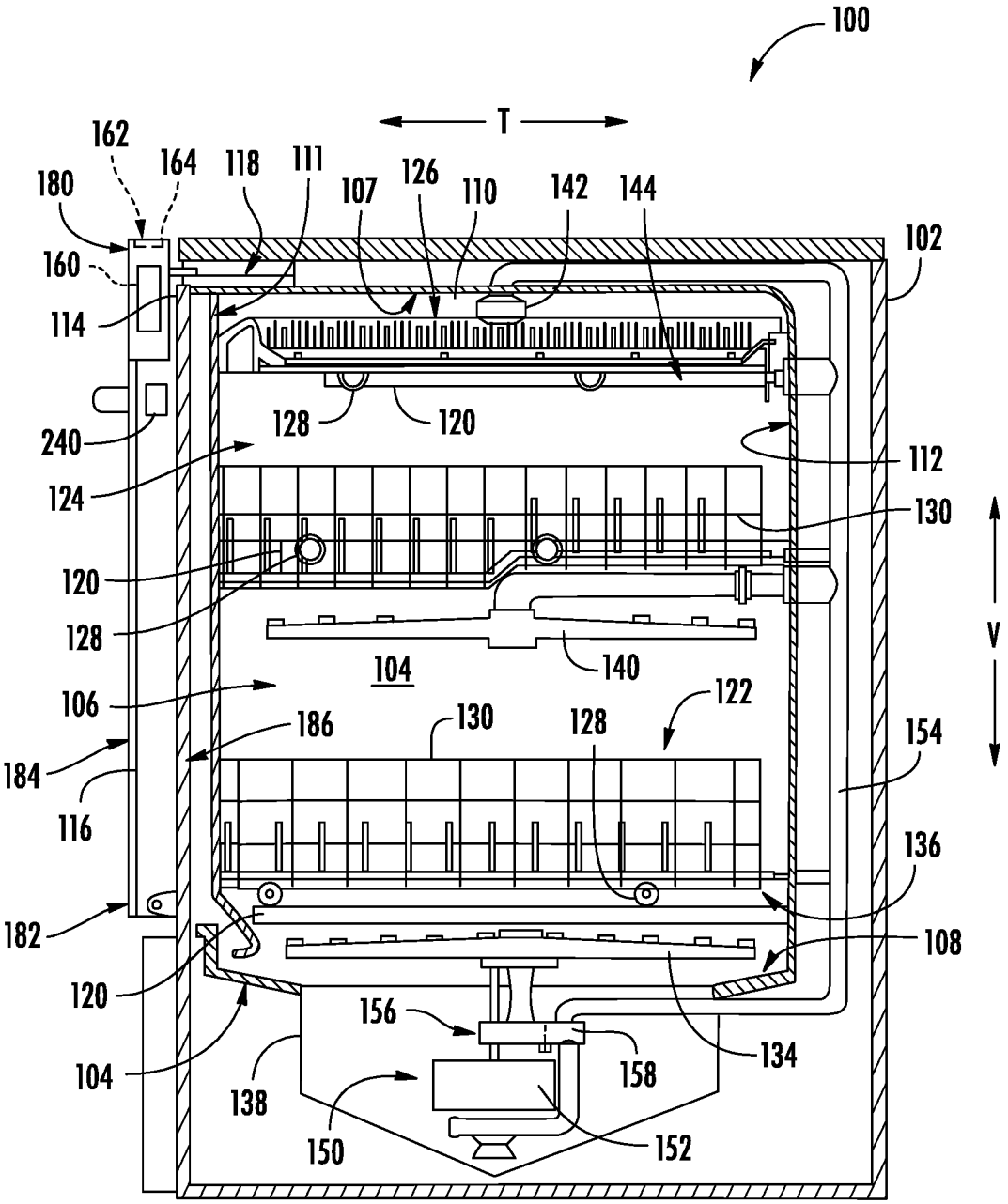
FIG. 2 provides a cross-sectional side view of the exemplary dishwashing appliance of FIG. 1 according to an example embodiment of the present disclosure.
Figure 3:
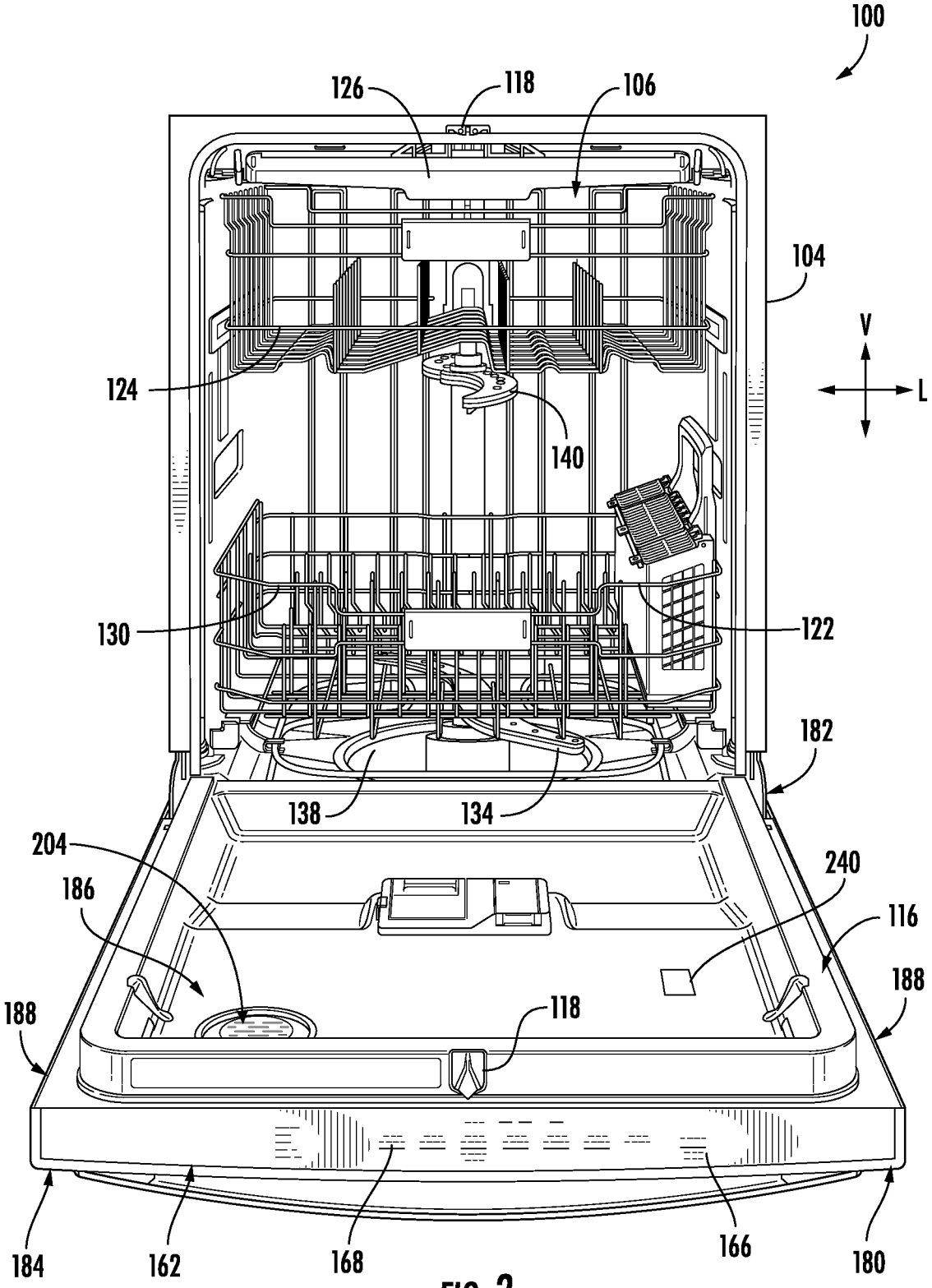
FIG. 3 provides a front view of the exemplary dishwashing appliance of FIG. 1 with a door open according to an example embodiment of the present disclosure.

FIGS. 1 and 2 depict an exemplary domestic dishwashing appliance or dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 may be in operative communication with a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electromechanical input devices including capacitive touch screens/buttons, rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Referring now generally to FIGS. 1 and 2, door 116 will be described according to exemplary embodiments of the present subject matter. Although door 116 is described herein as being used with dishwasher 100, it should be appreciated that door 116 or variations thereof may be used on any other suitable residential or commercial appliance. As described herein, door 116 may share a coordinate system with dishwasher 100, e.g., when door 116 is in the closed position (e.g., as shown in FIG. 2). Specifically, door 116 may define a vertical direction V, a lateral direction L, and a transverse direction T. Therefore, these directions may be used herein to refer to features of door 116 and its various components and sub-assemblies.

As shown, in the normally closed position, door 116 extends from a top end or top edge 180 to a bottom end or bottom edge 182 along the vertical direction V; from a front end 184 to a rear end 186 along the transverse direction T; and between two lateral ends 188 along the lateral direction L. According to exemplary embodiments, door 116 may be formed from one or more exterior panels that define an interior chamber of door 116. According to exemplary embodiments, the exterior panels of door 116 may be panels that are stamped from stainless steel or may be formed from any other suitably rigid material, such as thermoformed plastic, other metals, etc. In general, the exterior panels of door 116 may be assembled in any suitable manner, e.g., may be secured together using any suitable mechanical fastener, welding, snap-fit mechanisms, etc. In addition, it should be appreciated that an insulating material (not shown), such as fiberglass or foam insulation, may be positioned within door 116 to provide thermal and/or sound insulation to dishwasher 100.

Referring still to FIGS. 1 and 2, user interface panel 164 is positioned proximate top edge 180 of door 116 along the vertical direction V. In this manner, user interface panel 164 may be partially hidden below a countertop when dishwasher appliance 100 is installed below the countertop and door 116 is closed. Accordingly, dishwasher appliance 100 may be referred to as a "top control dishwasher appliance."

However, it should be appreciated that aspects of the present subject matter may be used with dishwasher appliances having other configurations or any other suitable appliance. For example, user interface panel 164 may be alternately positioned on front face or front end 184 of door 116.

User interface panel 164 is positioned on door 116 such that a user can engage or interact with user interface panel 164, e.g., to select operating cycles and parameters, activate/deactivate operating cycles, or adjust other operating parameters of dishwasher appliance 100. User interface panel 164 may include a printed circuit board (not shown) that is positioned within door 116. According to exemplary embodiments, printed circuit board may include or be operatively coupled to controller 160 and/or user interface panel 164. In addition, user interface panel 164 may include or be operably coupled to one or more user inputs or touch buttons (e.g., identified generally herein as user inputs 166) for receiving user input, providing user notifications, or illuminating to indicate cycle or operating status.

Specifically, according to the illustrated embodiment, user inputs 166 include a plurality of capacitive sensors that are mounted to user interface panel 164 and are operable to detect user inputs. For example, these capacitive sensors may be configured for triggering when a user touches a top edge 180 of user interface panel 164 in a region associated with a particular user input 166. In particular, these capacitive sensors can detect when a finger or another conductive material with a dielectric different than air contacts or approaches user interface panel 164, along with the precise location, pressure, etc. of the finger interaction.

When a user touches top edge 180 of user interface panel 164 adjacent one of user inputs 166, the associated capacitive sensors may be triggered and may communicate a corresponding signal to controller 160. In such a manner, operations of dishwasher appliance 100 can be initiated and controlled. According to exemplary embodiments, the capacitive sensors may be distributed laterally on user interface panel 164. It will be understood that other any suitable number, type, and position of capacitive sensors may be used while remaining within the scope of the present subject matter. Indeed, any suitable number, type, and configuration of user inputs 166 may be used while remaining within the scope of the present subject matter.

User interface panel 164 may define a plurality of surfaces that are intended to be illuminated for various purposes. For example, user inputs 166 may be illuminated by light sources to inform the user of the location of the button or to provide some other status indication. Notably, this illumination is typically achieved by directing a light beam along the vertical direction V onto top edge 180 of user interface panel 164. Door 116 may further include a plurality of light sources or lighting devices that are configured for illuminating one or more surfaces of user interface panel 164. It should be appreciated that these light sources may include any suitable number, type, configuration, and orientation of light sources mounted at any suitable location to illuminate status indicators or buttons in any suitable colors, sizes, patterns, etc. In other words, the light sources may be provided as any suitable number, type, position, and configuration of electrical light source(s), using any suitable light technology and illuminating in any suitable color. For example, the light sources may include one or more light emitting diodes (LEDs), which may each illuminate in a single color (e.g., white LEDs), or which may each illuminate in multiple colors (e.g., multi-color or RGB LEDs) depending on the control signal from controller 160.

However, it should be appreciated that according to alternative embodiments, the light sources may include any other suitable traditional light bulbs or sources, such as halogen bulbs, fluorescent bulbs, incandescent bulbs, glow bars, a fiber light source, etc. Moreover, the light sources may be operably coupled (e.g., electrically coupled) to controller 160 or another suitable control board to facilitate activation or illumination of the light sources (e.g., to indicate a user input, state of the dishwasher appliance, state of the wash cycle, or any other relevant information to a user).

According to exemplary embodiments, user interface panel 164 may be any suitable transparent or semitransparent feature for diffusing, directing, or otherwise transmitting light from a light source. For example, user interface panel 164 may be formed from a suitable transparent or translucent material configured to direct light energy, such as a dielectric material, such as glass or plastic, polycarbonate, polypropylene, polyacrylic, or any other suitable material.

In addition, user interface panel 164 may be a dead fronted panel. As used herein, the term "dead front" and the like is generally intended to refer to portions of a control panel which may be used as indicators, buttons, interactive control surfaces, or other user-interaction features without exposing the user to the operating side of the equipment or live parts and connections, i.e., lights, electrical connections, etc. For example, user interface panel 164 may include a transparent or translucent body and an opaque masking material that is selectively printed on top edge 180 of the translucent body to define capacitive touch buttons or user inputs 166.

The opaque material may be deposited on the translucent body to define any suitable number, size, and configuration of illuminated features. These illuminated features may be shapes or include other forms such as symbols, words, etc. that are visible on user interface panel 164. More specifically, when light sources are energized, capacitive touch buttons or user inputs 166 on top edge 180 may be illuminated. Thus, the dead fronted top edge 180 may be the surface that is contacted for controlling dishwasher appliance 100 or which may be illuminated for purposes of indicating operating status or other conditions to the user of the dishwasher appliance 100.

Referring still to FIG. 1, a schematic diagram of an external communication system 190 will be described according to an exemplary embodiment of the present subject matter. In general, external communication system 190 is configured for permitting interaction, data transfer, and other communications between dishwasher appliance 100 and one or more external devices. For example, this communication may be used to provide and receive operating parameters, user instructions or notifications, performance characteristics, user preferences, or any other suitable information for improved performance of dishwasher appliance 100. In addition, it should be appreciated that external communication system 190 may be used to transfer data or other information to improve performance of one or more external devices or appliances and/or improve user interaction with such devices.

For example, external communication system 190 permits controller 160 of dishwasher appliance 100 to communicate with a separate device external to dishwasher appliance 100, referred to generally herein as an external device 192. As described in more detail below, these communications may be facilitated using a wired or wireless connection, such as via a network 194. In general, external device 192 may be any suitable device separate from dishwasher appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with dishwasher appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control dishwasher appliance 100, etc. In addition, external device 192 and remote server 196 may communicate with dishwasher appliance 100 to communicate similar information.

In general, communication between dishwasher appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with dishwasher appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Referring now to FIGS. 3 through 6, dishwasher appliance 100 may further include a venting system 200 that is generally configured for exhausting or discharging hot, humid air from within the wash chamber 106. For example, venting system 200 may operate after a wash cycle in order to discharge humid air to facilitate an improved or expedited drying process. According to the illustrated embodiment, venting system 200 may be positioned within door 116 of dishwasher appliance 100. However, it should be appreciated that according to alternative embodiments, venting system 200 may be positioned within other locations of dishwasher appliance 100. In addition, it should be appreciated that venting system 200 may be in operative communication with controller 160 to facilitate operation at desired times during a dishwashing cycle and to facilitate the performance of the methods as described herein.

Specifically, according to the illustrated embodiment, venting system 200 may include a duct system 202 that is positioned between an inner and outer door panel of door 116, e.g., between front end 184 and rear end 186 of door 116. Duct system 202 may generally include a chamber air intake 204 which is positioned on an inner door panel for receiving a flow of chamber air (e.g., identified in FIG. 6 by reference numeral 206). Specifically, duct system 202 may include a first duct portion 208 that is fluidly coupled to chamber air intake 204 and a first fan 210 positioned within first duct portion 208 for urging the flow of chamber air 206 through duct system 202. Specifically, the flow chamber air 206 may be drawn from wash chamber 106 and discharged from duct system 202 at an air discharge vent 212. First fan 210 may be referred to generally herein as the "exhaust fan."

Figure 4:
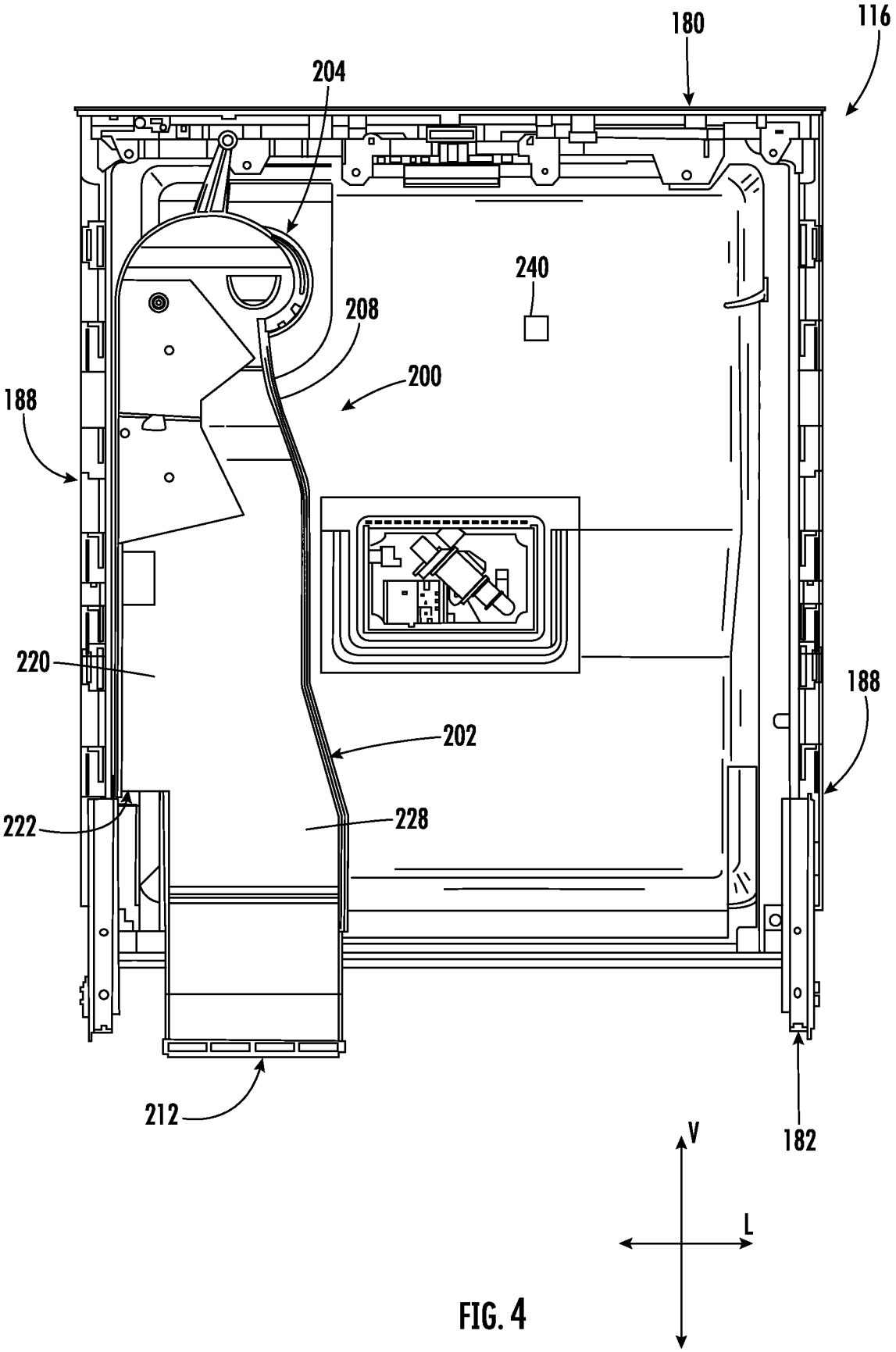
FIG. 4 provides a front view of a door of the example dishwasher appliance of FIG. 1 with an outer panel removed to reveal a venting system according to an example embodiment of the present subject matter.
Figure 5:
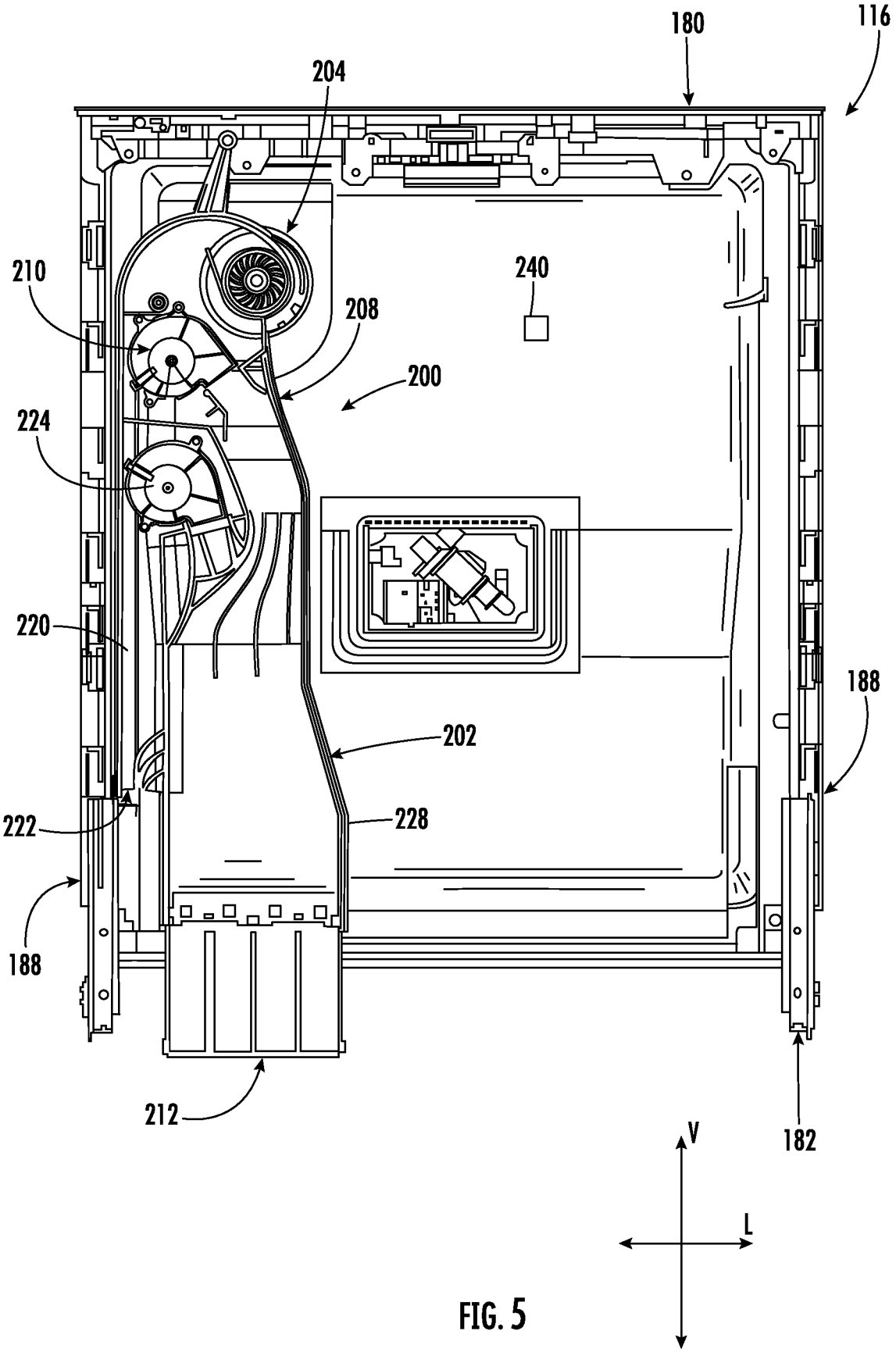
FIG. 5 provides a front view of the example venting system of FIG. 4 with a portion of the duct removed according to an example embodiment of the present subject matter.
Figure 6:
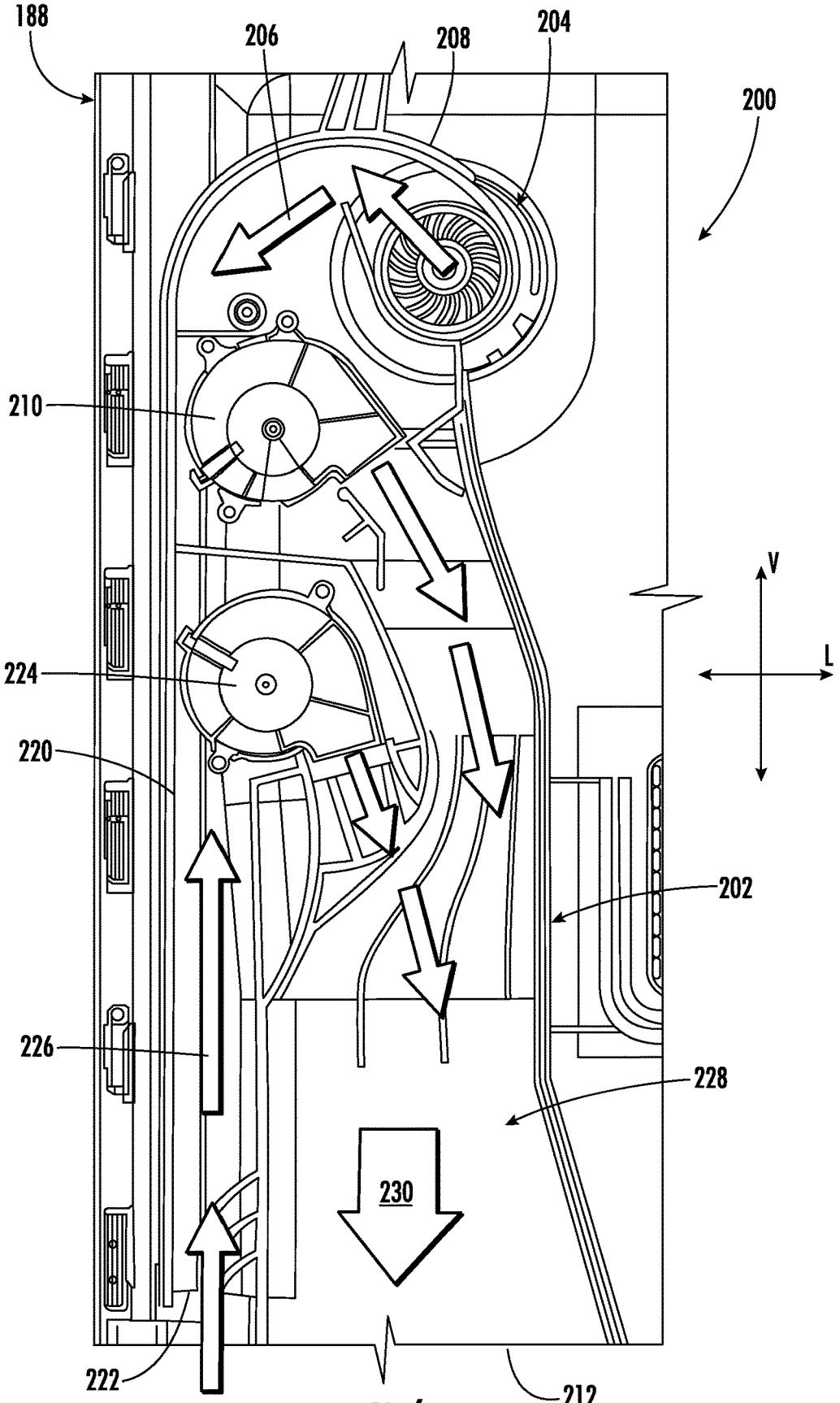
FIG. 6 provides a close-up view of the flows of air within the example venting system of FIG. 4 according to an example embodiment of the present subject matter.

Notably, as best illustrated in FIGS. 4 and 5, air discharge vent 212 may be positioned at a bottom edge 182 of door 116 and may direct air downward along the vertical direction V, e.g., on to the consumer's floor. Notably, if hot, humid air is discharged from venting system 200, this may damage the consumer floor, e.g., due to excessive heat and/or moisture. Accordingly, it may be desirable to mix the flow of chamber air 206 with a cooler, less humid flow of air before the mixture is discharged from dishwasher appliance 100.

Thus, according to example embodiments, duct system 202 may further include a second duct portion 220 that is fluidly coupled to an ambient air intake 222. Venting system 200 may further include a second fan 224 that is positioned within second duct portion 220 for drawing a flow of ambient air (e.g., identified in FIG. 6 by reference numeral 226) through ambient air intake 222 from outside of dishwasher appliance 100. In this regard, first duct portion 208 and the second duct portion 220 may be joined at a mixing portion 228 of duct system 202 where the flow of chamber air 206 and the flow of ambient air 226 may mix to form a mixed flow of air (e.g., identified generally in FIG. 6 by reference numeral 230). This mixed flow of air 230 may have a lower humidity and temperature suitable for discharging out of dishwasher appliance 100 through discharge vent 212. Second fan 224 may be referred to generally herein as the "auxiliary fan."

Although an exemplary venting system 200 and duct system 202 is described herein according to an example embodiment of the present subject matter, it should be appreciated that variations and modifications may be made to these systems while remaining within the scope of the present subject matter. For example, the position and configuration of duct system 202 may vary, the number and type of fans may differ, and other variations may be made without departing from the scope of the present subject matter. In addition, it should be appreciated that controller 160 may be in operative communication with first fan 210 and second fan 224 to operate venting system 200. For example, according to one embodiment, first fan 210 and second fan 224 may be operated simultaneously to ensure that hot, humid air is discharged from wash chamber 106 in a safe manner.

As noted above, it may be desirable to operate first fan 210 and second fan 224 simultaneously to ensure that any time heated air is withdrawn from wash chamber 106, it is mixed with cooler air to avoid hazardous situations. Notably, however, too much moisture in a dry venting system can result in rust or the breakdown of fans 210, 224 over time. The failure of one or both fans may further result in hazardous conditions, damage to dishwasher appliance 100 or the consumer's floor, poor drying performance, or other performance issues. Accordingly, aspects of the present subject matter are generally directed to methods for detecting the failure of venting system 200 and implementing corrective action.

Figure 8:
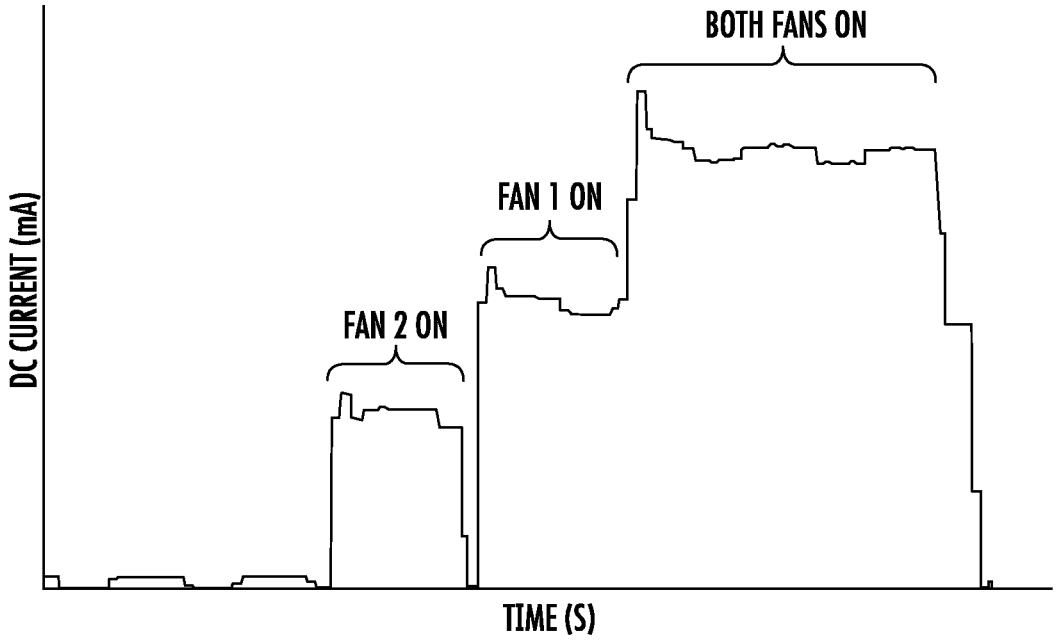
FIG. 8 is a plot of power drawn by a first fan and a second fan of the example venting system of FIG. 4 according to an example embodiment of the present subject matter.
Figure 9:
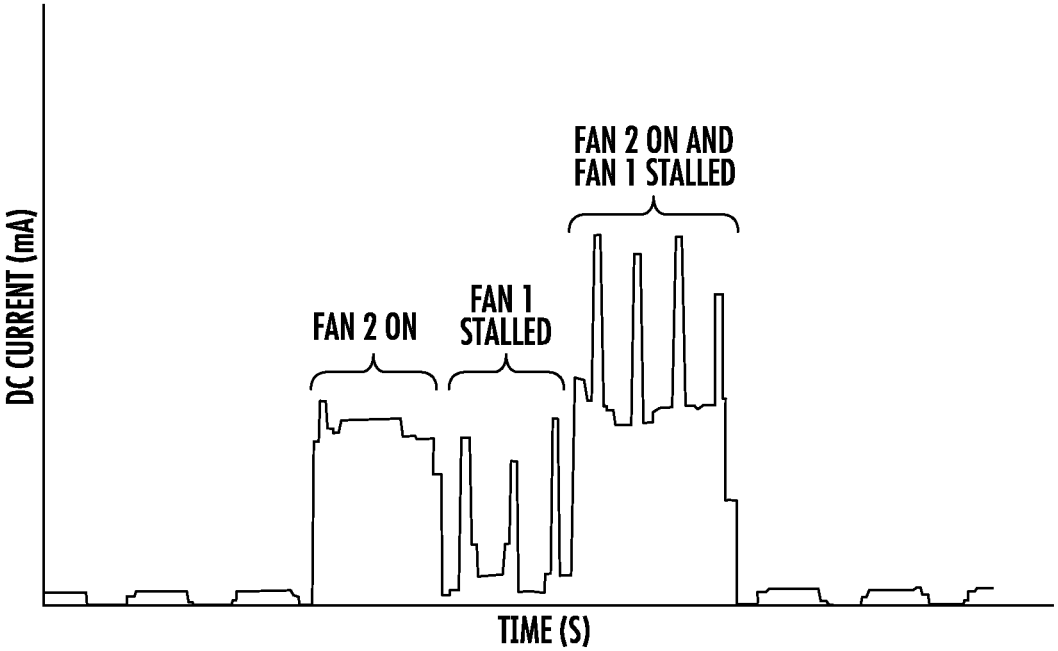
FIG. 9 is a plot of power drawn by a first fan and a second fan of the example venting system of FIG. 4 according to an example embodiment of the present subject matter.

For example, one manner of detecting a failure of venting system 200 may include monitoring the power drawn by first fan 210 and second fan 224 during operation of venting system 200. For example, controller 160 may monitor the power draw, e.g., using a DC current sensor. Notably, first fan 210 and second fan 224 may draw a specific amount of power or current during normal operation, e.g., in amps at a fixed DC bus voltage. In addition, fans 210, 224 may be different sizes or powers, such that monitoring a total power draw may facilitate the identification of issues specific to each respective fan 210, 224. For example, FIGS. 8 and 9 illustrate example plots showing the power draw by venting system 200 during various operating scenarios. As shown and described in more detail below, monitoring this power draw may facilitate determination of when each fan 210, 224 is operating or is experience operating issues, e.g., such as a stalled fan, a poor electrical connection, etc.

According to still other embodiments, another manner of detecting failure of venting system 200 may be monitoring sound generated during operation of venting system 200. Accordingly, dishwasher appliance 100 may include a microphone 240 that is positioned at any suitable location within the vicinity of dishwasher appliance 100 for monitoring sound generated by dishwasher appliance 100. For example, according to the illustrated embodiment, microphone 240 may be positioned within door 116. In general, microphone 240 may be used for monitoring the sound waves, noises, or other vibrations generated during the operation of dishwasher appliance 100. For example, microphone 240 may be one or more microphones, acoustic detection devices, vibration sensors, or any other suitable acoustic transducers that are positioned at one or more locations in or around dishwasher appliance 100. As shown for example in FIG. 10, sound detected by microphone 240 during the operation of venting system 200 may be used to monitor operation of venting system 200, as described in more detail below.

Now that the construction of dishwasher appliance 100 and venting system 200 according to exemplary embodiments have been presented, an exemplary method 300 of operating a dishwasher appliance will be described. Although the discussion below refers to the exemplary method 300 of operating dishwasher appliance 100, one skilled in the art will appreciate that the exemplary method 300 is applicable to the operation of a variety of other dishwasher appliances and venting systems.

In exemplary embodiments, the various method steps as disclosed herein may be performed by controller 160 or a separate, dedicated controller. In this regard, as described herein, controller 160 of dishwasher appliance 100 may implement all steps of method 300. However, it should be appreciated that according to alternative embodiments, controller 160 may offload the analysis described herein, e.g., by sending sound signals and power draw data to remote server 196 for analysis. Other distributed analysis arrangements are possible and within the scope of the present subject matter.

Figure 7:
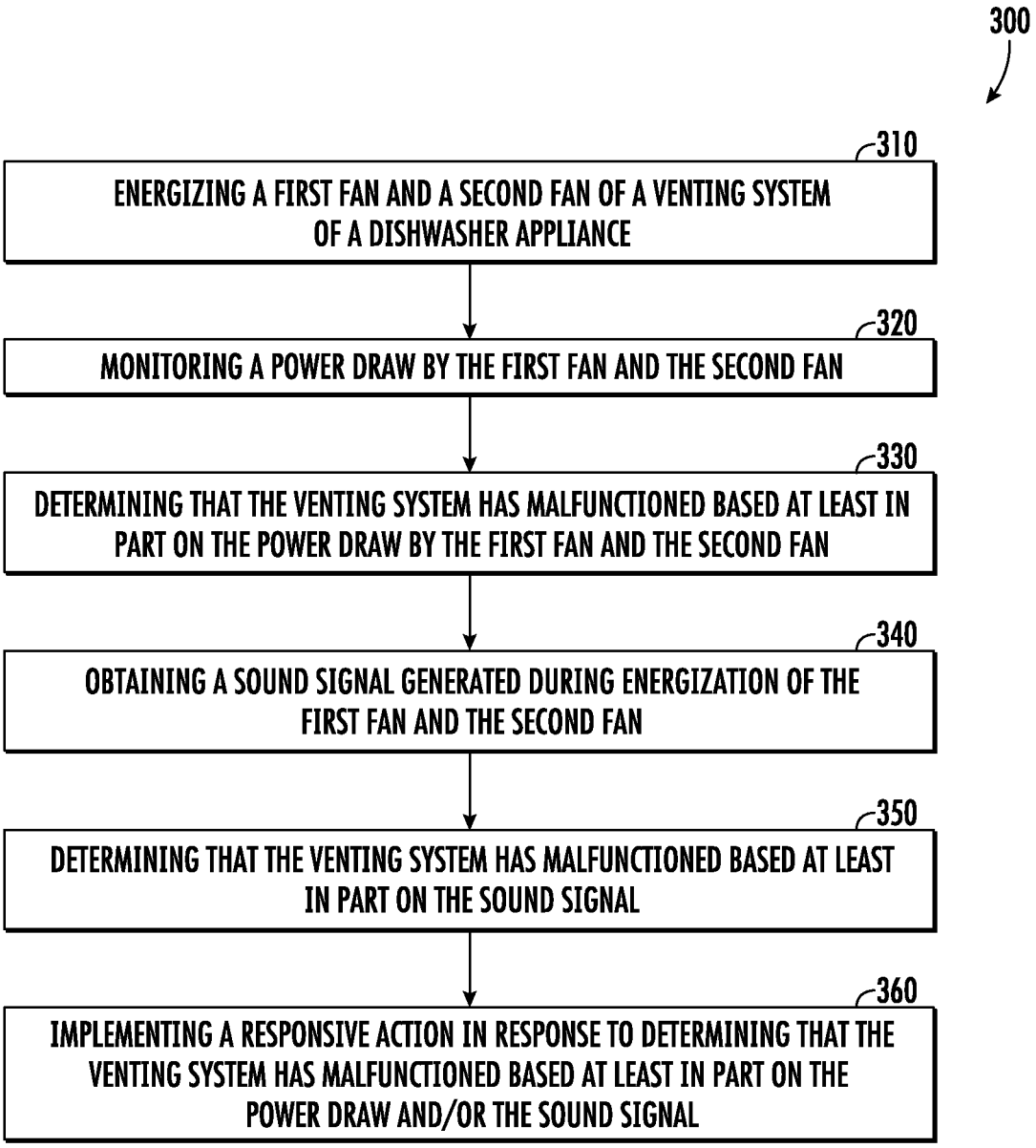
FIG. 7 illustrates a method for operating a dishwasher appliance in accordance with one embodiment of the present disclosure.

Referring now to FIG. 7, method 300 includes, at step 310, energizing a first fan and a second fan of a venting system of a dishwasher appliance. In this regard, continuing the example from above, at a target time within an operating cycle of dishwasher appliance 100, controller 160 may operate or energize fans 210, 224 by supplying DC power with the intention of drawing in the flow of chamber air 206 and the flow of ambient air 226, which are thereafter mixed and discharged as mixed flow 230.

Step 320 may generally include monitoring a power draw by the first fan and the second fan. For example, controller 160 may monitor a power draw as shown in FIGS. 8 and 9. As explained above, method 300 may include utilizing information related to power drawn by venting system 200 to determine the operational status of one or both of first fan 210 and second fan 224. For example, method 300 may include determining whether fans 210, 224 are operating or may identify other operating issues related to fans 210, 224.

Specifically, step 330 may include determining that the venting system has malfunctioned based at least in part on the power draw by the first fan and the second fan. For example, according to example embodiments, first fan 210 may generally draw around 300 mA during normal operation and second fan 224 may generally draw around 180 mA during normal operation. It should be appreciated that the power draw of each fan 210, 224 may vary while remaining within the scope of the present subject matter. Accordingly, as shown in FIG. 8, if the power draw is around 180 mA, it may be determined that only second fan 224 is operating. Furthermore, if the power draw is around 300 mA, it may be determined that only first fan 210 is operating. If the power draw is around 480 mA, it may be determined that both first fan 210 and second fan 224 are operating simultaneously. It should be appreciated that the power draw values used herein are only exemplary and are not intended to limit the scope of the present subject matter in any manner.

Thus, determining the operational state of venting system 200 may include comparing the measured power drawn to known operating thresholds, ranges, limits, etc. In this regard for example, method 300 may include determining that the power draw is below a nominal power level (e.g., below 50 mA) and determining that the first fan and the second fan are not operating. In this regard, if the drawn power is below the rated power level of the fans, method 300 may include determining that neither fan is operating. For example, this may be due to an electrical issue, a faulty controller, or other issues with dishwasher appliance 100.

According to example embodiments, determining that the venting system has malfunctioned based at least in part in the power draw may include determining that the power draw is within a first power range. For example, the first power range may include upper and lower boundaries that include the standard operating amperage of first fan 210. For example, if the standard operating amperage of first fan 210 is 300 mA, the first power range may be between about 200 and 400 mA, between about 250 and 350 mA, or between about 270 and 330 mA. Accordingly, determining that the power drawn falls within this first power range may result in a determination that the first fan is operating in the second fan is not operating.

According to example embodiments, determining that the venting system has malfunctioned based at least in part in the power draw may include determining that the power draw is within a second power range. For example, the second power range may include upper and lower boundaries that include the standard operating amperage of second fan 224. For example, if the standard operating amperage of second fan 224 is 180 mA, the first power range may be between about 80 and 280 mA, between about 130 and 230 mA, or between about 150 and 210 mA. Accordingly, determining that the power drawn falls within this second power range may result in a determination that the second fan is operating in the first fan is not operating.

According to example embodiments, method 300 may further include determining that the venting system 200 is operating properly based on the power draw from the first fan 210 and second fan 224. In this regard, for example, method 300 may include determining that the power draw is within a third power range that includes upper and lower boundaries that include the summation of the standard operating amperage of first fan 210 and second fan 224. For example, if the standard operating amperage of first fan 210 is 300 mA and the operating amperage of second fan 224 is 180 mA, the third power range may be between about 400 and 560 mA, between about 430 and 530 mA, or between about 450 and 510 mA. Accordingly, determining that the power drawn falls within this third power range may result in a determination that both the first fan and second fan are operating properly.

According to still other embodiments, method 300 may include the identification of other operating issues with venting system 200. For example, the power draw may be monitored to identify perturbations, spikes, or other aberrations in the power draw on by first fan 210 and/or second fan 224. In this regard, as shown in FIG. 9, spikes in the power draw may generally be indicative of a fan that is stalled, e.g., due to a mechanical blockage, rust, or other fan failures. For example, the current spikes may be due to controller 160 periodically trying to restart fan rotation (or an on-board motor controller that is integrated into the fan module, e.g., if controller 160 does not have any direct speed feedback from the fan). Method 300 may include identifying issues related to the operation of each fan based on power draw signatures, such as the frequency, amplitude, or other characteristics of variations in the power draw.

As explained above, method 300 may utilize the power drawn by venting system 200 to identify operating issues with venting system 200. By contrast, according to an example embodiment, method 300 may alternatively rely on sound signals generated during energization of venting system 200 a microphone mounted on a door of the dishwasher appliance. In this regard, during energization of first fan 210 and second fan 224, controller 160 may use microphone 240 to monitor sounds or noises generated within and around dishwasher appliance 100. By monitoring the sound generated, controller 160 may identify issues with venting system 200, such as a fan failure. As explained below, method 300 may utilize sound signals alone to determine the failure of dispensing assembly 200.

Figure 10:
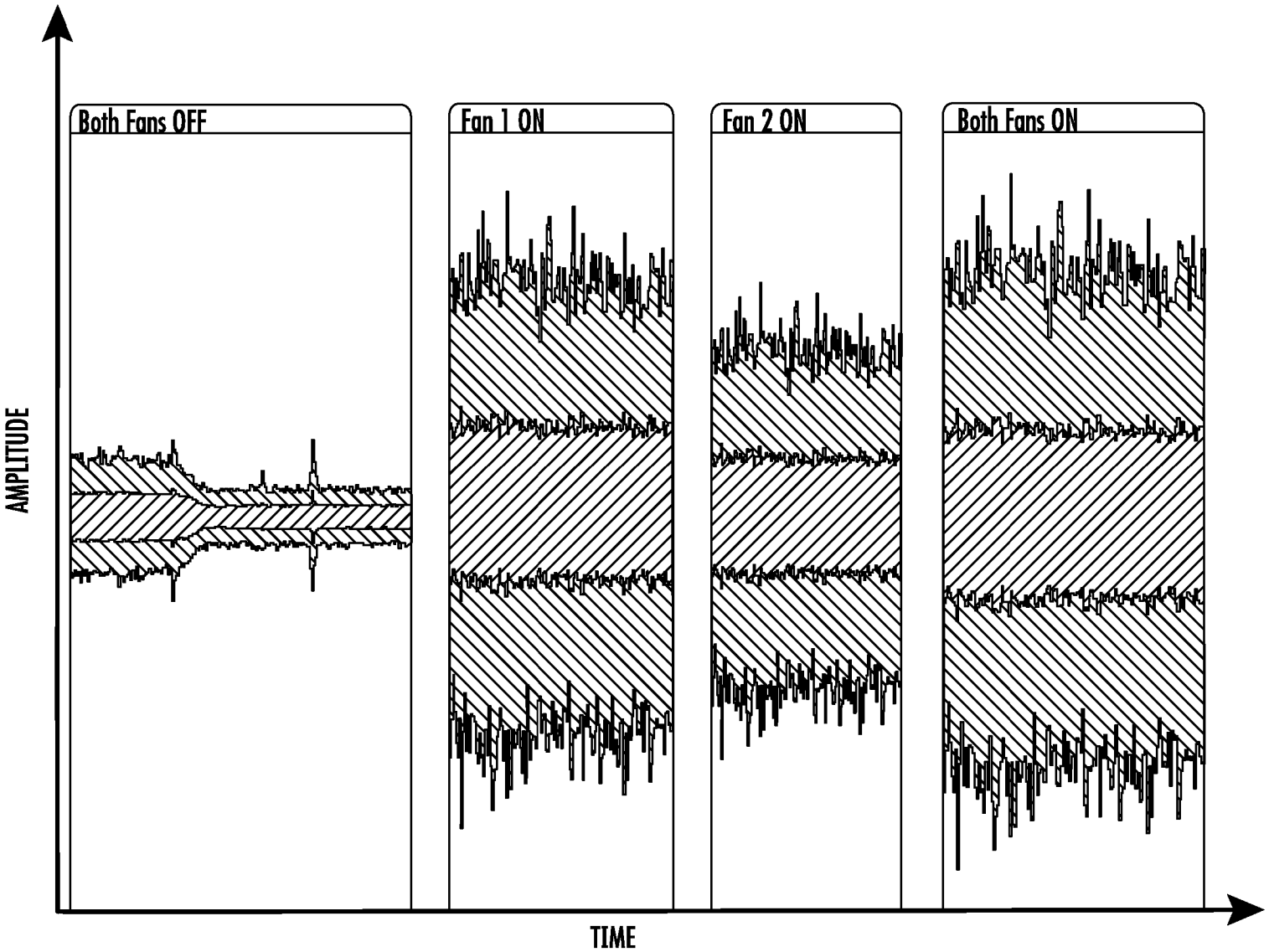
FIG. 10 is a plot of an audio signal generated during operation of the first fan and the second fan of the example venting system of FIG. 4 according to an example embodiment of the present subject matter.

For example, method 300 may include, at step 340, obtaining a sound signal generated during energization of the first fan and the second fan. Step 350 may include determining that the venting system has malfunctioned based at least in part on the sound signal. For example, method 300 may include determining that an amplitude of the sounds signal falls within a predetermined sound threshold range. For example, as shown in FIG. 10, each fan may generate sound having a specific amplitude, e.g., which may loosely correspond to the power levels described above. Controller 160 may be programmed to know the sound signatures or amplitudes of operation associated with the operation of each fan 210, 224. By monitoring the sound signal, controller 160 may be programmed to determine whether one or both of fans 210, 224 are operating, e.g., by tracking the amplitude of the sound signals relative to predefined ranges. It should be appreciated that the steps for monitoring power draw (e.g., step 320 and 330) and the steps for monitoring sound signals (e.g., steps 340 and 350) may be used independently or in conjunction to improve the confidence of faulty fan detection or other venting system issues.

Step 360 may generally include implementing a responsive action in response to determining that the venting system has malfunctioned based at least in part on the power draw and/or the sound signal. For example, implementing the responsive action may include providing a user notification that venting system has malfunctioned. This user notification may be communicated to the user in any suitable manner. For example, the user notification may be provided through a user interface panel (such as user interface panel 164), e.g., such as by illuminating a venting system failure light indicator. According to still other embodiments, the user notification regarding the venting system failure may be communicated directly to the user through external device 192 (e.g., such as the user's cell phone) via network 194. According to still other embodiments, the user notification may be provided to a smart speaker, to another connected appliance, or any other suitable device. In addition, according to example embodiments, method 300 may include communicating with a service technician, scheduling a maintenance service, ordering a new venting system part, etc.

FIG. 7 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 are explained using dishwasher appliance 100 and venting system 200 as an example, it should be appreciated that this method may be applied to the operation of any suitable venting system in any suitable dishwasher appliance.

As explained above, aspects of the present subject matter are generally directed to a method for detecting a failure in a multi-fan dry system located in a dishwasher door. The multi-fan dry system may include an upper fan and a lower fan, where each fan draws a different current during operation. A microphone in the inner door may be used to obtain audio signatures of the fan operation, which may be used to deduce whether the fans are OFF or ON as well as to diagnose other operating conditions. The electrical power draw and/or the audio signature of the door fans in normal operation may be used as a baseline of a properly working fans in the dishwasher's dry system. If the door fans stray from the normal operation condition it can be heard and measured electrically. For example, a stalled exhaust fan may be detected by observing periodic spikes of approximately 175 mA amplitude in the DC current measurement while the fan is state is set to ON. The sum of the audio signature and electrical current reading may be used to determine whether the door fans are operating as designed. In addition, if failure is detected, the audio and/or power draw signatures may be used to identify which of the fans is not running properly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

a wash tub positioned within a cabinet and defining a wash chamber;

a door pivotally mounted to the cabinet to provide selective access to the wash chamber;

a duct defining a chamber air intake, an ambient air intake, and an air discharge vent;

a venting system comprising an exhaust fan for urging chamber air from the wash chamber and an auxiliary fan for urging ambient air from outside the cabinet, wherein the chamber air and the ambient air mix within the duct to create a mixed flow of air that is discharged from the dishwasher appliance; and a controller in operative communication with the exhaust fan and the auxiliary fan, the controller being configured to:

energize the exhaust fan and the auxiliary fan;

monitor a power draw by the exhaust fan and the auxiliary fan;

determine that the venting system has malfunctioned based at least in part on the power draw by the exhaust fan and the auxiliary fan by determining that the power draw is within a first power range and determining that the exhaust fan is operating and the auxiliary fan is not operating; and implement a responsive action in response to determining that the venting system has malfunctioned based at least in part on the power draw.

2. The dishwasher appliance of claim 1, wherein the controller is further configured to:

determine that the power draw is below a nominal power level; and determine that the exhaust fan is not operating.

3. The dishwasher appliance of claim 1, wherein the controller is further configured to:

identify power draw perturbations from the power draw; and determine that the exhaust fan has stalled.

4. The dishwasher appliance of claim 1, wherein the first power range is between about 270 and 330 milliamps.

5. The dishwasher appliance of claim 1, wherein determining that the venting system has malfunctioned based at least in part on the power draw comprises:

determining that the power draw is within a second power range; and determining that the auxiliary fan is operating and the exhaust fan is not operating.

6. The dishwasher appliance of claim 5, wherein the second power range is between about 150 and 210 milliamps.

7. The dishwasher appliance of claim 1, wherein the controller is further configured to:

determine that the power draw is within a third power range; and determine that the exhaust fan is operating and the auxiliary fan is operating.

8. The dishwasher appliance of claim 7, wherein the third power range is between about 450 and 510 milliamps.

9. The dishwasher appliance of claim 1, wherein the controller is further configured to:

determine that the power draw is a below a nominal power level; and determine that the exhaust fan and the auxiliary fan are not operating.

10. The dishwasher appliance of claim 1, wherein the controller is further configured to:

identify power draw perturbations from the power draw; and determine that at least one of the exhaust fan or the auxiliary fan has stalled.

11. The dishwasher appliance of claim 1, further comprising a microphone for monitoring sound generated during operation of the dishwasher appliance, wherein the controller is further configured to:

obtain a sound signal generated during energization of the exhaust fan and the auxiliary fan;

determine that the venting system has malfunctioned based at least in part on the sound signal; and implement a responsive action in response to determining that the venting system has malfunctioned based at least in part on the sound signal.

12. The dishwasher appliance of claim 11, wherein determining that the venting system has malfunctioned based at least in part on the sound signal comprises:

determining that an amplitude of the sound signal falls within a predetermined sound threshold range.

13. The dishwasher appliance of claim 11, wherein the microphone is mounted within the door.

14. The dishwasher appliance of claim 1, wherein the duct is positioned within the door.

15. The dishwasher appliance of claim 1, wherein implementing the responsive action comprises:

providing a user notification that the venting system has malfunctioned.

16. The dishwasher appliance of claim 15, wherein the user notification is provided through a user interface panel, or wherein the controller is in operative communication with a remote device through an external network, and wherein the user notification is provided through the remote device.

17. A dishwasher appliance defining a vertical direction, a lateral direction, and a transverse direction, the dishwasher appliance comprising:

a wash tub positioned within a cabinet and defining a wash chamber;

a door pivotally mounted to the cabinet to provide selective access to the wash chamber;

a duct defining a chamber air intake, an ambient air intake, and an air discharge vent;

a venting system comprising an exhaust fan for urging chamber air from the wash chamber and an auxiliary fan for urging ambient air from outside the cabinet, wherein the chamber air and the ambient air mix within the duct to create a mixed flow of air that is discharged from the dishwasher appliance; and a controller in operative communication with the exhaust fan and the auxiliary fan, the controller being configured to:

energize the exhaust fan and the auxiliary fan;

monitor a power draw by the exhaust fan and the auxiliary fan;

determine that the venting system has malfunctioned based at least in part on the power draw by the exhaust fan and the auxiliary fan;

implement a responsive action in response to determining that the venting system has malfunctioned based at least in part on the power draw;

determine that the power draw is within a third power range; and determine that the exhaust fan is operating and the auxiliary fan is operating.

* * * * *